United States Patent [19]

Föhl

[11] 4,393,555

[45] Jul. 19, 1983

[54] BELT LOCK FOR A SAFETY BELT

[75] Inventor: Föhl, Schorndorf, Fed. Rep. of Germany

[73] Assignee: Repa Feinstanzwerk GmbH, Alfdorf, Fed. Rep. of Germany

[21] Appl. No.: 250,039

[22] Filed: Apr. 1, 1981

[30] Foreign Application Priority Data

Apr. 2, 1980 [DE] Fed. Rep. of Germany ..... 3012939

[51] Int. Cl.[3] ..... A44B 11/26

[52] U.S. Cl. ..... 24/230 A

[58] Field of Search ..... 24/230 A, 136 A, 211 N

[56] References Cited

U.S. PATENT DOCUMENTS 3,597,811 8/1971 Cunningham ..... 24/230 A 3,935,618 2/1976 Fohl ..... 24/230 A

*Primary Examiner*—Hugh R. Chamblee

*Attorney, Agent, or Firm*—Herbert L. Lerner; Laurence A. Greenberg

[57] ABSTRACT

Belt lock for a safety belt with a plug-in guide provided in a lock-housing for a belt plug-in tongue. The tongue can be arrested in the plug-in guide by a latch mechanism, and can be unlocked by operation of a pressure element against the force of a spring. The plug-in tongue is provided at one side at a longitudinal edge with an engagement detent in which a latch of the locking mechanism can engage. The tongue has a guide profile at its forward end, seen in the plug-in direction which profile fits only at the correct insertion mode with a mating surface in the plug-in guide.

6 Claims, 3 Drawing Figures

BELT LOCK FOR A SAFETY BELT

CROSS-REFERENCE TO RELATED APPLICATION

My application, Ser. No. 250,040, filed on Apr. 1, 1981.

BACKGROUND OF THE INVENTION

1. Field of the Invention

The invention relates to a belt lock for a safety belt with a plug-in guide provided in a lock-housing for a belt plug-in tongue which can, by a latch mechanism be arrested in the plug-in guide, and which can be unlocked by operation of a pressure organ against the force of a spring.

2. Description of the Prior Art

In the known safety belt systems comprising a plug-in tongue and a belt lock, at least one latch is provided in the interior of a stable metallic lock-housing. The latch can swing on a swing-axis and is pressed by a spring into the plug-in guide for the tongue. In the known arrangements, the plug-in tongue is symmetrically shaped, i.e. it has, in a symmetrical arrangement on both sides of the median- or plug-in axis, two engagement edges (detents), which are open toward the outside, and engage behind one or two symmetrical latches when the tongue is inserted into the belt lock. The plug-in tongue has a considerable width due to the two detent edges. Correspondingly, the width of the plug-in guide of the belt lock must also be relatively wide to receive this tongue.

SUMMARY OF THE INVENTION

An object of the invention is to provide a belt lock of the initially described type constructed in a manner that the dimensions of the belt lock can be reduced in comparison to known designs, while its safety function is assured.

With the foregoing and other objects in view, there is provided in accordance with the invention a lock for a safety belt comprising a belt lock having alock-housing with an insertion path, a plug-in tongue with an engagement detent at one side at a longitudinal edge for insertion in the insertion path of the lock-housing, a latch mechanism having a latch for engaging the detent of the plug-in tongue inserted in the insertion path, said tongue having a guide-profile at its forward end, seen in the profile direction, said insertion path having a mating surface which fits the guide-profile of said tongue only when correctly inserted, and a pressure element movable against the force of a spring to move said latch out of engagement with said tongue to permit withdrawal of the tongue from the belt lock.

Other features which are considered as characteristic for the invention are set forth in the appended claims.

Although the invention is illustrated and described herein as embodied in a belt lock for a safety belt, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings in which.

DETAILED DESCRIPTION OF THE INVENTION

Figures 1, 2:
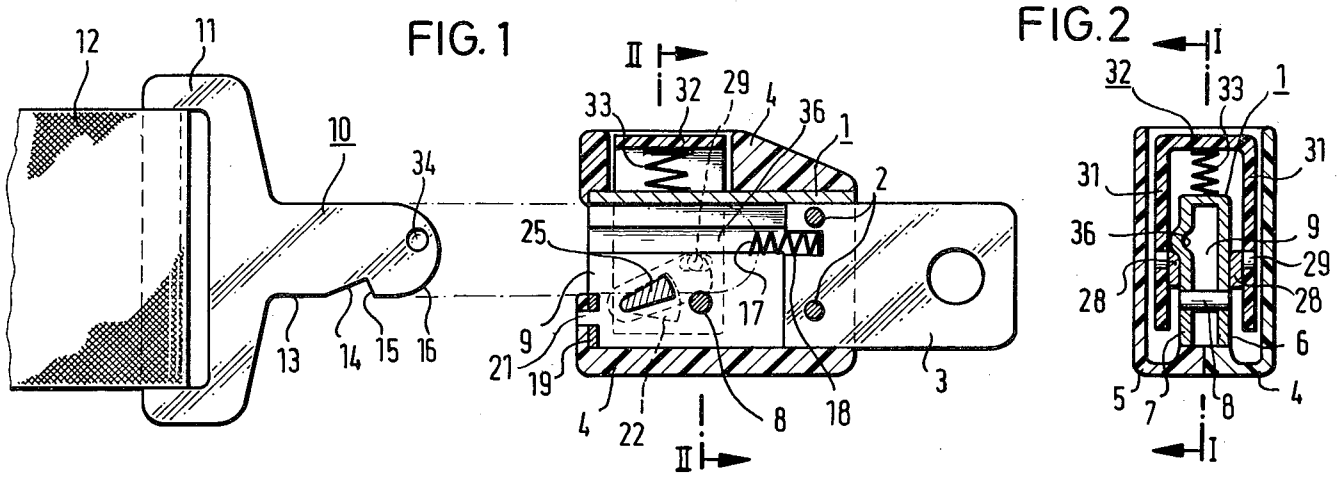
FIG. 1 is a sectional view of the belt lock according to the invention taken along line I—I of FIG. 2, together with the plug-in tongue. The drawings show a wart-like stamped projection on the tongue and a groove-like bulge in the plate of the housing forming an insertion path for the plug-in tongue.
FIG. 2 is a sectional view of the belt lock taken along line II—II of FIG. 1.
Figure 3:
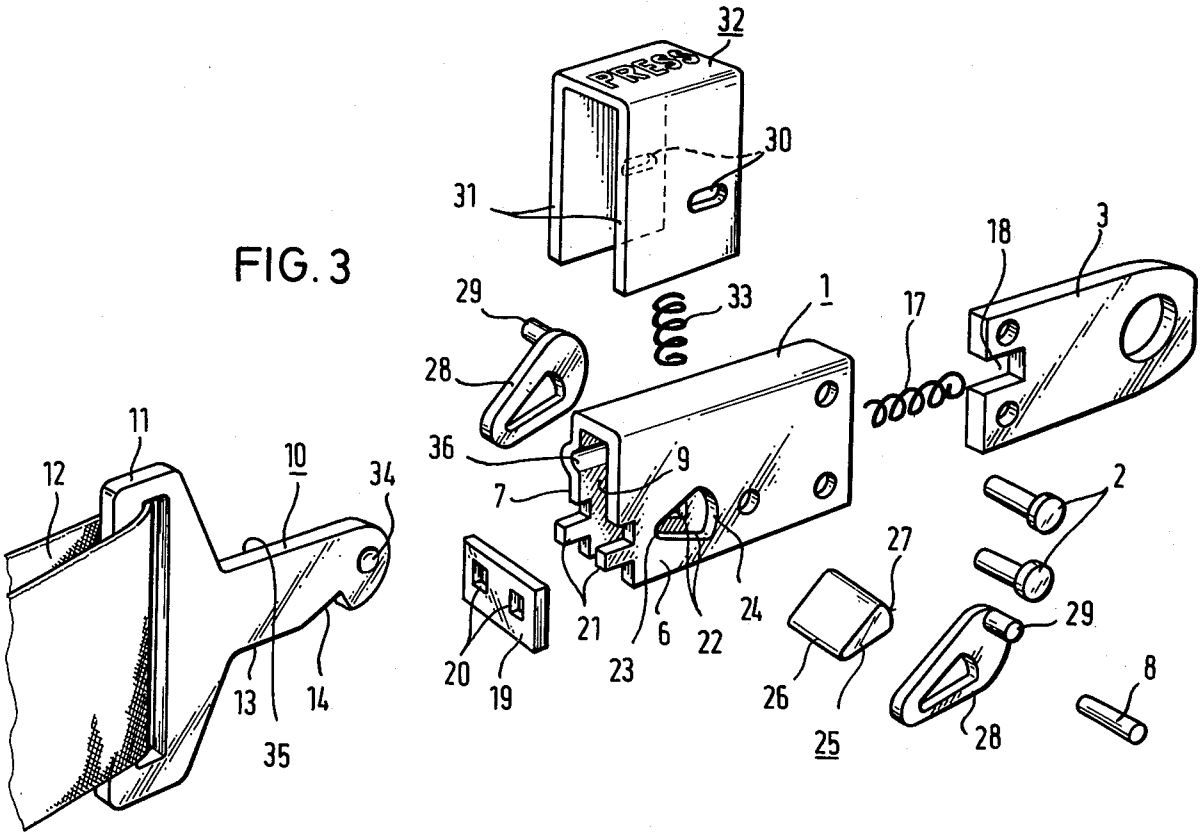
FIG. 3 shows an exploded view of the belt-lock with the plug-in tongue according to FIGS. 1 and 2.

According to the invention the plug-in tongue is provided at one side at a longitudinal edge with an engagement detent in which a latch of the locking mechanism can engage. The tongue has a guide profile at its forward end, seen in the plug-in direction, which profile fits only at the correct insertion mode with a mating surface of the plug-in guide.

By arranging only one engagement detent at one of the longitudinal edges of the plug-in tongue, the width of the tongue is considerably reduced in comparison with known constructions with symmetrical detents, wherein such width of the tongue is required to fully maintain transfer of the force to the tongue. Correspondingly, the width of the plug-in guide, the whole width of the lock housing and of the belt lock can be reduced. In order to prevent wrong insertion of the tongue into the insertion path of the housing, i.e. 180° inverted insertion of the tongue into the belt lock which also causes a certain elastic clamping of the spring-tensioned latch on the smooth longitudinal edge of the tongue, and thereby effects an "apparent locking", which give the user the impression that a correctly latched connection has occurred, provision is made, that the plug-in tongue can only be inserted into the plug-in guide in the correct position. Thereby, the shortcoming which could affect an asymmetrical plug-in tongue system is completely eliminated with a small construction change. In this manner a wrong insertion and thereby a spurious locking cannot occur. An especially simple construction of the guide-profile and the matching counter guide is obtained by providing the plug-in tongue at its flat side with a wart-like stamped projection which is raised above the flat side of the tongue, and is guided loosely with play in a groove-like bulge in the lock housing which extends along the push-in guide.

In a particularly advantageous form of the invention, the insertion and the pull-out of the tongue is considerably improved, with a very simple construction form, wherein in the opposite positioned plates of the lock housing, which is made as a U-shaped bent part, there are provided wedge-shaped, preferably sector-shaped openings, in which at least one correspondingly wedge-shaped latch with a smaller wedge angle is hingeably supported. The latch is connected with a pressure element by a lever mechanism. With respect to the known constructions with rectangular latches, this has the advantage that, in particular at the insertion of the tongue, the leading pressure edge of the tongue acts on a relative long lever arm of the latch, so that less force is required to insert the tongue. In contrast thereto, the tongue acts on a very short lever arm with respect to the pivot arm of a latch with a rectangular cross-section, which makes the insertion more difficult, and wear is correspondingly high with continuous usage.

According to a further development of the invention, the latch is rounded at the point of the wedge, and is supported in suitably rounded wedge-ends of the support openings so that it can swing and it is provided on its other side with a convex bearing edge for the plug-in tongue. In this manner, an under-cut is avoided between the detent of the tongue and the support edge of the latch when detenting, so that when the latch is released, i.e. at its motion out of the plug-in guide, the tongue remains in the detent position, i.e. it does not move in the push-in direction. Further advantageous details of the invention can be learned from the typical embodiment shown in the drawings, and described in the following.

Referring to the drawings, a U-shaped metallic housing 1 is made as a formed stamped part, to which a fastening lug 3 is attached by two rivets 2. Lug 3 can be attached, for example, to a holding rope which is secured to the floor of the vehicle. The housing 1 of the lock is surrounded by two housing shells 4 and 5 made of plastic, which together enclose the housing 1. A guide pin 8 is supported in the plates 4 and 5, which together with the inner surfaces of the plates 6 and 7 form an insertion path 9 for a metallic plug-in tongue 10. The end of a flexible safety belt 12 is fastened in the ear-like expanded portion 11 of tongue 10, and the other belt end is fixed to the frame of the vehicle, at a so-called automatic roll-up device. The plug-in tongue 10 in the shown embodiment is provided at one longitudinal edge 13 with a detent 14 which is open to the outside, and has a slanted engagement edge 15 which continues into a run-up slant 16. This plug-in tongue 10 can be inserted by hand into the plug-in path 9 of the housing 1, up to the position shown in dashed lines in FIG. 1. The guide pin 8 serves for supporting and guiding of the inserted tongue, and prevents a deviation of the latter. During the insertion, the plug-in tongue 10 presses against an ejection spring 17 disposed in a notch 18 of the fastening lug 3, to make certain that after loosening the connection between the housing 1 and the plug-in tongue 10, the latter is ejected from the housing 1.

A retainer plate 19 is provided with two cut-outs 20, and can be pushed onto two lugs 21 of the housing 1, and which at one hand maintains the distance between the plates 6 and 7, and also limits the entrance of the plug-in path 9 directing the tongue 10 toward the back.

In the plates 6 and 7 of the housing 1 there are wedge or sector-shaped support openings 22, which at the narrow wedge endings are provided with round corners 23, and with concavely arched edges 24 at the other side. In these support openings 22, a latch 25, which also has a wedge shape and a smaller wedge angle than the support openings 22 is hingeably supported. The latch 25 is rounded at its small end 26, and is hingeably or pivotably supported in the round corners 23 of the support openings 22, while its other wider end is provided with a convexly curved support edge 27, corresponding to the contour of the support openings 22. The latch 25 consists of a material having greater hardness and stiffness than the engagement edge 15 of the tongue 10, so that the engagement edge 15 adjusts itself to the form of the latch 25 at an extreme load on the safety belt 12 in the case of a crash. At both sides of the plates 6 and 7 are plate-like lever elements 28 fastened to the ends of the latch 25, for example by press-fits, or formed on the latch. Levers 28 are provided with freely extending lever pins 29, which lie outside of the swing-axis of the latch 25. Onto these lever pins 29 can be snapped on the free, form-stable legs 31 with guide slots 30 of a U-shaped pressure element 32 "Press". This hand-operated pressure organ 32 straddles the housing 1, is guided at the side of the housing, and tensioned by a spring 33 in the non-operating position. A part of the cam-edge (wear edge) 27 of the latch 25 projects over the described lever mechanism into the push-in path 9, and—after insertion of the tongue 10—engages with the detent edge 15, as shown in FIG. 1. By pressing the pressure organ 32 against the spring force 33, the latch 25 is moved outside of the push-in path 9, so that the plug-in tongue 10 is released. By means of the special form and arrangement of the latch 25 the plug-in tongue 10 does not move when the latch 25 is displaced; the tongue 10 stays in its position until the locking-connection is completely freed.

As the drawings show, the plug-in tongue 10 is provided at its forward end in the plug-in direction with a wart-like stamped shape 34, which extends beyond one flat side 35 of the plug-in tongue 10. Correspondingly, a groove-like recess 36 is stamped into a plate 7 of the housing 1, along the plug-in path 9. By the asymetrical guide profile of the plug-in tongue 10 (stamped shape 34), and the matching counter-guide (bulge 36) of the housing 1, it is assured that the tongue 10 can only be inserted into the lock housing 1 in one, correct position, and cannot be inserted with the sides reversed. If this were possible, due to the friction of the elastically tensioned latch 25 on the smooth edge of the tongue which lies on the opposite side of the detent 14, an "apparent locking", i.e. an arresting of the tongue 10 to a certain degree, could take place, which would simulate an effective engagement, without actually obtaining the latter. As shown in FIGS. 1 and 2, the motion of the pressure organ 32 in the not-operating position is limited by the hitting of the corresponding lever element 28 at the bulge 36 of the lock-housing 1.

There is claimed:

1. Lock for a safety belt comprising a belt lock having a lock-housing with an insertion path, a plug-in tongue with an engagement detent only at one side at a longitudinal edge for insertion in the insertion path of the lock-housing, a latch mechanism having a latch for engaging the detent of the plug-in tongue inserted in the insertion path, said tongue having a guide-profile at its forward end, seen in the profile direction, said insertion path having a mating surface which fits the guide-profile of said tongue only when correctly inserted, a pressure element movable against the force of a spring to move said latch out of engagement with said tongue to permit withdrawal of the tongue from the belt lock, and wherein the plug-in tongue is provided with a wart-like, stamped projection which is raised above the tongue's flat side, and which is guided loosely with play in a groove-like bulge in the housing.

2. Belt lock according to claim 1, wherein the lock-housing is a U-shaped, bent part, with opposite disposed plates in which are wedge-shaped, support openings, in which is hingeably supported a wedge-shaped latch with a smaller wedge-angle, and wherein said latch is connected with said pressure element by a lever drive.

3. Belt lock according to claim 1 or claim 2, wherein the latch is rounded at the point of the wedge, and is hingeably supported in said correspondingly rounded wedge-shaped endings of the support openings, and wherein said latch is provided at the other side with a convexly arched support edge for the plug-in tongue.

4. Lock for a safety belt comprising a belt lock having a lock-housing with an insertion path, a plug-in tongue with an engagement detent at one side at a longitudinal edge for insertion in the insertion path of the lock-housing, a latch mechanism having a latch for engaging the detent of the plug-in tongue inserted in the insertion path, said tongue having a guide-profile at its forward end, seen in the profile direction, said insertion path having a mating surface which fits the guide-profile of said tongue only when correctly inserted, and a pressure element movable against the force of a spring to move said latch out of engagement with said tongue to permit withdrawal of the tongue from the belt lock, wherein the lock-housing is a U-shaped, bent part, with opposite disposed plates in which are wedge-shaped, support openings, in which is hingeably supported a wedge-shaped latch with a smaller wedge-angle, and wherein said latch is connected with said pressure element by a lever drive and, wherein at both sides of said plates lever elements are connected with the latch, which lever elements are guided by means of formed lever pins in guide slots of the pressure element, which latter can be pressed on or snapped onto the lever pins of the lever elements.

5. Lock for a safety belt comprising a belt lock having a lock-housing with an insertion path, a plug-in tongue with an engagement detent at one side at a longitudinal edge for insertion in the insertion path of the lock-housing, a latch mechanism having a latch for engaging the detent of the plug-in tongue inserted in the insertion path, said tongue having a guide-profile at its forward end, seen in the profile direction, said insertion path having a mating surface which fits the guide-profile of said tongue only when correctly inserted, and a pressure element movable against the force of a spring to move said latch out of engagement with said tongue to permit withdrawal of the tongue from the belt lock, wherein the plug-in tongue is provided with a wart-like, stamped projection which is raised above the tongue's flat side, and which is guided loosely with play in a groove-like bulge in the housing, wherein the lock-housing is a U-shaped, bent part, with opposite disposed plates in which are wedge-shaped, support openings, in which is hingeably supported a wedge-shaped latch with a smaller wedge-angle, and wherein said latch is connected with said pressure element by a lever drive, and wherein at both sides of said plates lever elements are connected with the latch, which lever elements are guided by means of formed lever pins in guide slots of the pressure element, which latter can be pressed on or snapped onto the lever pins of the lever elements.

6. Belt lock according to claim 5, wherein the U-shaped pressure element straddles the oppositely disposed plate, and is guided alongside of the latter, and wherein the bulge in one of the plates serves as stop for limiting the motion of the pressure element.

* * * * *